US006637631B2

(12) United States Patent
Lafoux et al.

(10) Patent No.: US 6,637,631 B2
(45) Date of Patent: Oct. 28, 2003

(54) KNAPSACK FITTED WITH AN ANGULAR DAMPER BETWEEN THE BACK OF THE BAG AND THE STRAP AND/OR BELT ASSEMBLY

(75) Inventors: Antoine Lafoux, Annecy le Vieux (FR); Stéphane Belledame, Croix (FR); Fabian Guret, Bereyziat (FR); Franck Barbier, Marly (FR)

(73) Assignee: Decathlon, Villeneuve d'Ascq (FR)

( * ) Notice: Subject to any disclaimer, the term of this patent is extended or adjusted under 35 U.S.C. 154(b) by 196 days.

(21) Appl. No.: 09/955,515

(22) Filed: Sep. 18, 2001

(65) Prior Publication Data

US 2002/0033404 A1 Mar. 21, 2002

(30) Foreign Application Priority Data

Sep. 20, 2000 (FR) ..... 00 11985

(51) Int. Cl.[7] ..... A45F 3/04
(52) U.S. Cl. ..... 224/197; 224/604; 224/637
(58) Field of Search ..... 224/578, 581, 224/637, 604, 605, 610, 641, 648, 649, 259, 271, 272, 197, FOR 210, 209

(56) References Cited

U.S. PATENT DOCUMENTS 4,793,031 A * 12/1988 Kasai ..... 24/324
5,016,791 A * 5/1991 Burow ..... 224/197
5,284,279 A * 2/1994 Sason et al. ..... 224/637
5,954,250 A 9/1999 Hall et al.
6,299,044 B1 * 10/2001 Klindworth-Garron ..... 224/637
6,311,884 B1 * 11/2001 Johnson ..... 224/637
6,474,523 B2 * 11/2002 Morrison et al. ..... 224/578
6,474,524 B1 * 11/2002 Ivarson et al. ..... 224/637
6,484,916 B1 * 11/2002 Salom et al. ..... 224/637

FOREIGN PATENT DOCUMENTS

EP 0260959 A2 3/1988
EP 0628265 A1 12/1994

* cited by examiner

*Primary Examiner*—Nathan J. Newhouse
(74) *Attorney, Agent, or Firm*—Wolf, Greenfield & Sacks, P.C.

(57) ABSTRACT

A knapsack has a bag, a strap assembly for attaching the bag to the shoulders of a user, a belt assembly for attaching the bag around the waist of a user and a fastening system for fastening the strap assembly and/or the belt assembly to the back of the bag. The fastening system has a first piece secured to the strap assembly and/or the belt assembly and a second piece secured to the back of the back. The first and second pieces co-operate with each other to enable the first and second pieces to be fastened together and pivot mutually about an axis perpendicular to the back of the bag. The fastening system has at least one elastomer element secured to one of the pieces and the other piece has a portion that causes the elastomer element to be deformed during pivoting, thereby opposing the pivotal movement.

17 Claims, 6 Drawing Sheets

KNAPSACK FITTED WITH AN ANGULAR DAMPER BETWEEN THE BACK OF THE BAG AND THE STRAP AND/OR BELT ASSEMBLY

The present invention relates to an improved knapsack in which the system for securing the strap assembly and/or the belt assembly to the back or frame of the knapsack is fitted with a damper for damping angular pivoting.

BACKGROUND OF THE INVENTION

A knapsack is constituted by a container or bag, with a strap assembly enabling the knapsack to be secured to the shoulders of the user, and with a belt assembly for securing the knapsack around the waist of the user, said strap and belt assemblies being generally fixed to the back of the bag and optionally to a stiffening frame.

Proposals have already been made in document EP 0 260 959 for a fastening system between the knapsack bag and the strap assembly which allows the strap assembly to pivot angularly relative to the bag. That fastening system comprises a male piece which is secured to the strap assembly and which includes a projecting fixing head, and a female piece secured to the back of the bag, presenting a central recess and means for locking the fixing head once it has penetrated into the central recess. Specifically, the male piece includes a kind of peg made up of a plurality of flexible branches each terminated by a projecting catch, while the female piece has a hole terminated by an annular shoulder. The respective dimensions of the peg and of the hole are such that the peg penetrates into the hole by virtue of its component branches bending, and the two pieces are locked together by the projecting catches extending into the annular shoulder. This allows the male piece to pivot in either direction about the pivot axis, i.e. the axis of the peg, thereby enabling the strap assembly to track movements of the user while traveling.

In a particular embodiment of document EP 0 260 959, provision is made to limit the angular pivoting of the male and female pieces by means of a kind of stud which is provided on the male piece and which penetrates into a groove formed in the female piece. The end uprights of the groove define the maximum angular stroke between the male and female pieces.

Nevertheless, in that document, no attempt is made to damp displacement of the two pieces relative to each other between the two abutments. Thus, depending on the particular movements of the user, jolts can be imparted to the strap assembly whenever the relative angular displacement between the two pieces would otherwise exceed the maximum angular stroke as defined by the abutments.

Document EP 0 628 265 similarly describes a fastening system between the back of a knapsack bag and a belt assembly, which system allows for angular pivoting of the belt assembly relative to the back of the bag by means of a rather complex set of pieces. That document makes provision for a system of abutments that define a maximum angular stroke, and also a set of flexible tongues each having one end fixed securely to a piece forming part of the belt assembly and an opposite end which is free and which penetrates into a respective notch provided in a piece which is secured to the knapsack. During angular pivoting, the tongues are caused to deform, depending on the angular position adopted. Although not explicitly stated in the text of that document, it can be assumed that the tongues do not deform without a certain amount of force being exerted, with said force thus opposing angular pivoting. It should be observed that the presence of the abutments is essential since otherwise the free ends of the flexible tongues could escape from the notches in the event of angular pivoting through too great an amplitude.

OBJECTS AND SUMMARY OF THE INVENTION

The object of the present invention is to provide a knapsack which includes a fastening system allowing angular pivoting between the back of the bag and the strap (and/or belt) assembly but without requiring the presence of abutments for defining the maximum stroke of such pivoting, and which provides progressive damping of the forces involved during such pivoting.

This object is fully achieved by the knapsack of the invention. In conventional manner, the knapsack of the invention comprises a container or bag, a strap assembly for securing the bag to the shoulders of the user, a belt assembly for securing the bag around the waist of the user, and a fastening system for fastening the strap (and/or belt) assembly to the back of the bag, said fastening system comprising a first piece secured to the strap (and/or belt) assembly and a second piece secured to the back of the bag, said pieces co-operating with each other to enable the first and second pieces to be fastened together and to pivot about a pivot axis perpendicular to the back of the bag.

In characteristic manner of the invention, the fastening system comprises:

a) at least one elastomer element secured to one of the two pieces; and b) engagement means secured to the other piece and engaging the elastomer element at least during pivoting so that during pivoting the engagement means causes the elastomer element to be deformed, thereby opposing said pivoting.

Angular pivoting of the strap (and/or belt) assembly relative to the bag causes the elastomer element to be deformed in its zone adjacent to the means driving it in the pivot direction. Thus, in the fastening system of the invention, there is no abutment defining the maximum angular stroke or pivoting. It is the ability of the elastomer element to deform that absorbs the forces involved during relative movements of the user's body, and thus of the strap (and/or belt) assembly which tracks such movements. Depending on the relative position and on the structure of the elastomer element and of the first and second pieces, the deformation can be of the compression, traction, twisting, shear, or bending type.

The elastomer used is determined as a function of the volume of the bag and thus of the average weight carried thereby so that the angular pivoting lies in a range of −5° to +5° about a normal position.

The generic term "elastomer" should naturally be understood to mean not only synthetic elastomers but also rubbers. It is preferable to use a vulcanized elastomer or a thermoplastic elastomer having determined hardness on the Shore A scale.

The engagement means can be of various kinds: it can be constituted by purely mechanical means or by adhesive means. By way of example, when the engagement means are constituted by adhesive means, the two opposite faces of the elastomer element are stuck respectively to the first and second pieces; relative pivoting of the two pieces deforms the element in shear across its thickness. Nevertheless, there is a risk of the elastomer element coming unstuck in use. Mechanical means are therefore preferred.

In a mechanical embodiment, the elastomer element is fixed via two anchor points to the rear face of the first piece and presents at least one hollow zone between the two anchor points; in addition, the front face of the second piece has a projecting stud, said stud penetrating snugly into the hollow zone of the elastomer element when the two pieces are fastened together.

Depending on its direction, angular pivoting of the strap (and/or belt) assembly relative to the back of the bag causes one or other of the two zones of the elastomer element lying between the hollow zone and the two anchor points to be deformed in compression.

The elastomer element preferably includes at least one rib, and the stud is preferably in the form of an elongate shoulder suitable for engaging in the corresponding rib, the ribs and the shoulders extending radially relative to the pivot axis. By means of this particular disposition, the contact area between the elastomer element and the stud is increased thus enabling deformation of the elastomer element to be distributed uniformly during pivoting.

Advantageously, the elastomer element is in the form of an annular or part-annular strip, centered on the pivot axis; in addition the fastening system has two diametrically opposite assemblies each constituted by one or more hollow zones, together with optional radial ribs, and one or more studs, together with optional elongate shoulders.

This particular disposition makes it possible to spread the forces involved during compression of the elastomer strip over both assemblies. The two assemblies in question are preferably disposed symmetrically about the vertical axis (DD') of the bag so as to obtain a structure that is entirely homogeneous and symmetrical.

The first piece which is secured to the strap (and/or belt) assembly is preferably a male piece having a fixing head which projects from the rear face of said piece, while the second piece which is secured to the back of the bag is a female piece presenting a central recess opening out in its front face, said male and female pieces co-operating with each other to enable the male piece to be fastened to the female piece so as to be capable of pivoting about a pivot axis corresponding to the axis of the fixing head.

The fixing head is preferably mounted to rotate freely relative to the male piece in a housing that opens out into both faces of the male piece; the head is terminated at one end by a handling tab or knob which the user can access via the opening leading into the housing from the front face of the male piece, and at the other end the head is terminated by a T-shaped fastening portion; in addition, the central recess of the female piece carries two lips for retaining the two limbs of the T-shape after the fastening portion of the fixing head has penetrated into the recess and after the handling tab has been turned through a determined angle, preferably of 90°. This particular disposition enables the male and females pieces to be fastened together without any need to cause said pieces to pivot relative to each other, where such pivoting would be difficult or indeed impossible because of the presence of the studs in the interface between said two pieces. Because it is possible to turn the fixing head in its housing, it suffices to position the two pieces accurately relative to each other, with the studs being received in the hollow zones of the elastomer strip, and with the T-shaped fastening portion of the fixing head penetrating into the recess of the female piece, and then to turn the knob through 90° so as to lock the male and female pieces together.

Under such circumstances, it is advantageous for the housing for the fixing head to include an internal abutment and snap-fastening system serving firstly to limit rotation of the knob to a determined angle which is preferably 90°, and secondly to provide a degree of locking for the fixing head on reaching either of the two positions that are separated by said angle, i.e. a first position in which the front portion of the fixing head is inserted into the recess, and a second position in which it is locked, after being turned.

In order to make it easier to center the male and female pieces, and also in order to distribute the shear forces between said two pieces while the knapsack is being worn, the male and female pieces preferably include two circular portions both centered on the pivot axis, one portion projecting and the other being set back, and said portions being suitable for being received one within the other. The setback circular portion is preferably formed in the female piece, with the projecting circular portion being formed on the male piece.

In a preferred embodiment, the second piece, in particular the female piece, is integrated in the reinforcement for stiffening the knapsack bag; the reinforcement preferably includes a plurality of superposed elements similar to second pieces, in particular female pieces, distributed in its height direction thus enabling the height at which the strap (and/or belt) assembly is positioned relative to the bag to be adjusted.

BRIEF DESCRIPTION OF THE DRAWINGS

The present invention will be better understood on reading the following description of a preferred embodiment of a knapsack in which the strap assembly is secured to the back of the bag by a fastening system that pivots angularly and that includes an elastomer damper, as shown in the accompanying drawings, in which.

MORE DETAILED DESCRIPTION

Figure 1:
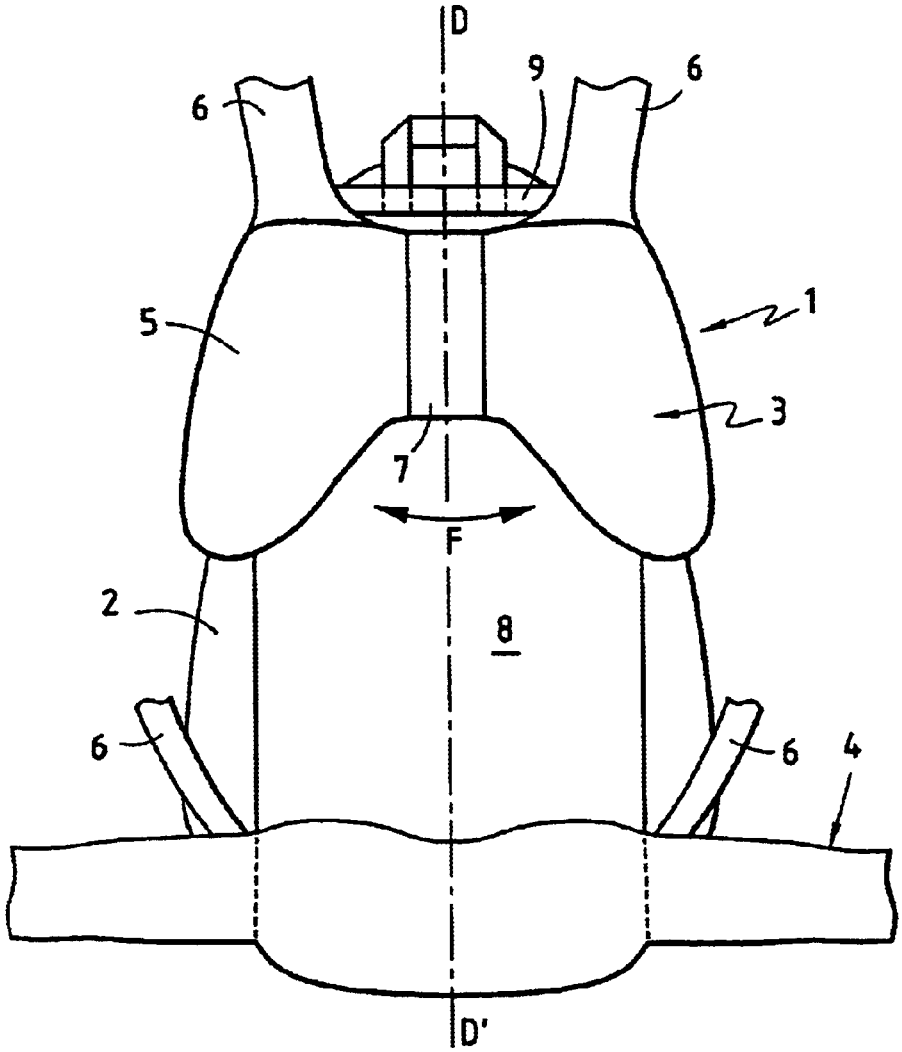
FIG.1 PRIOR ART
FIG. 1 is a front view of the back of a knapsack, representing the state of the art.
Figure 2:
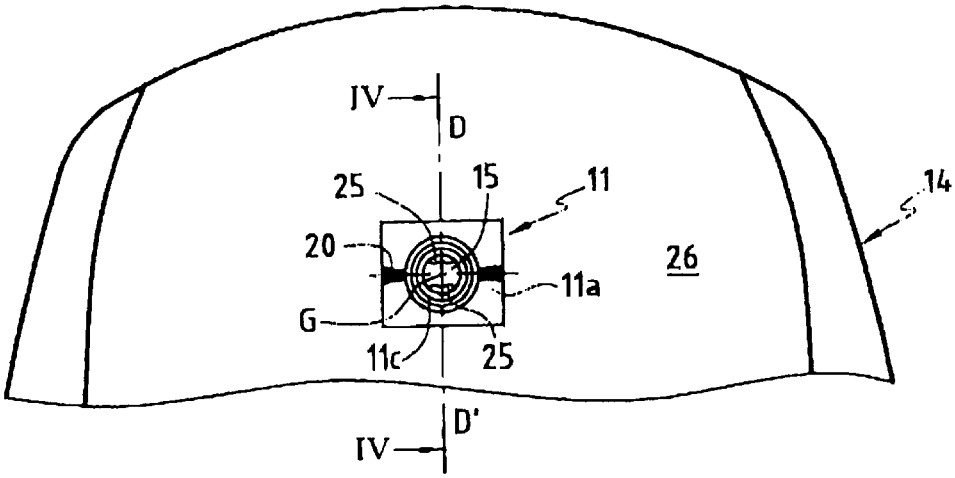
FIG. 2 is a front view of the back of a knapsack fitted with a female piece in accordance with the invention.

The knapsack 1 in the state of the art as constituted by document WO 00/19863 comprises a bag 2, a strap assembly 3, and a belt assembly 4. Specifically, the strap assembly 3 is made up of a one-piece shoulder-blade pad element 5 and two carrying straps 6 connecting the top portions of the two side zones of the one-piece element 5 to the bottom of the bag 2. The bag 2 is secured to the one-piece shoulder-blade pad element 5 via the central zone 7 of said one-piece element 5, with said one-piece element 5 being free to pivot to a certain extent relative to the back 8 of the knapsack, as represented by arrow F, the pivot axis being perpendicular to the back of the bag. In the example shown in the above-mentioned document, this ability to pivot is obtained by structural deformation of the flexible material constituting the back of the bag. When fixing is obtained by stitching, in particular, provision is made to limit this natural deformation by stiffening the portion of the back of the bag which is in the vicinity of the fixing zone, for example by stitching a strap 9 transversely to the top portion of the back, at a short distance from the fixing zone.

The present invention relates to a system for fixing or fastening the strap assemble (and/or the belt assembly) to the back of the bag other than by stitching and in which angular pivoting is not obtained by natural deformation of the flexible material constituting the back of the bag, since such deformation can run the risk of spoiling or even tearing said material.

For this purpose, the invention uses a fastening system which comprises two distinct pieces, and in the example shown they comprise a male piece 10 and a female piece 11. The male piece 10 is secured to the strap assembly 12 and possesses a fixing head 13 whose middle axis G perpendicular to the back 6 of the knapsack constitutes the angular pivot axis. The female piece 11 is secured to the back 26 of the knapsack 14 and presents a central recess 15 into which the fixing head 13 can penetrate, and also possesses locking means for locking said head once it has penetrated, with said locking not preventing the male piece 10 from being able to pivot angularly relative to the female piece 11. Such a fastening system is already known from document EP 0 260 959. In characteristic manner, the fastening system of the invention further includes at least one elastomer element which acts as a damper during angular pivoting of the strap assembly 12 relative to the back 26 of the knapsack 14. In the example shown, the elastomer element is a strip 16 which is fixed to the rear face 10*a* of the male piece via two anchor points. More precisely, the strip 16 is received in a housing 18 formed in the rear face 10*a* of the male piece. Furthermore, the bottom of this housing 18 is provided with two anchor tabs 17, 17' suitable for engaging in recesses or hollow portions formed in said strip 16. In addition, the strip 16 has a groove 19 situated at substantially equal distances from the two tabs 17, 17'. The groove 19 is shaped to receive exactly a transverse shoulder 20 projecting from the front face 11*a* of the female piece 11 when the male and female pieces 10 and 11 are fastened together, the faces 10*a* and 10*b* then being pressed against each other. To make them easier to bring into register, the rib 19 is of V-shape cross-section with two diverging sloping side walls 19*a* and 19*b* and a plane base 19*c*. The transverse shoulder 20 is of complementary configuration.

Angular pivoting of the strap assembly 12 relative to the back 26 of the bag, as caused by relative movements of the user's body, is impeded to some extent by the shoulder 20 on the female piece 11 penetrating into the groove 19 in the elastomer strip 16. More precisely, this pivoting is braked and damped by that portion of the elastomer strip 16 which is situated between the groove 19 and the tab 17 in the direction of rotation along arrow H being compressed, while the other portion of the elastomer material between the groove 19 and the other tab 17' is optionally deformed in traction and is lengthened. Depending on the forces involved in the relative movements of the user's body, pivoting thus takes place to a greater or lesser extent, given that the damping function of the elastomer strip depends on its technical characteristics and also on the distance between the grooves 19 and the tabs 17, 17', i.e. on the quantity of elastomer available for being compressed. It should be observed that the two pieces are returned elastically in the opposite direction when the forces involved are released, by virtue of the elastomer decompressing.

Figure 3:
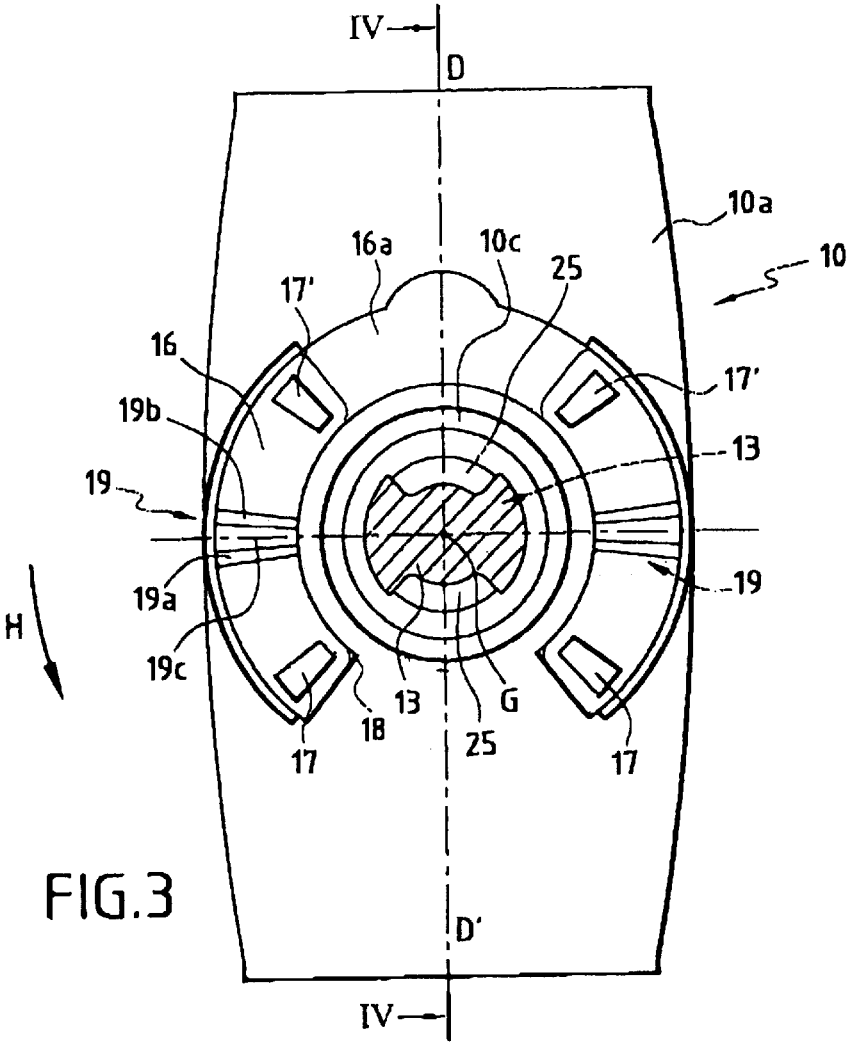
FIG. 3 is a front view of the rear face of a male piece in accordance with the invention.

In the preferred example shown in FIG. 3, a single, part-annular strip 16 has two damping configurations disposed symmetrically about the midplane DD' of the knapsack containing the pivot axis G, each damping configuration comprising a radial groove 19 and two anchor tabs 17 and 17'. The portion of the strip 16 which extends between the two inner anchor points 17' does not perform any active function in damping angular pivoting. Nevertheless, advantage is taken thereof to enable the user to see that the strap assembly does indeed include a damping elastomer strip by looking through a window formed in the male piece 10 so as to leave a portion of said strip visible on the front face 10*b* of said male piece 10, i.e. its face which is visible and accessible to the user while the strap assembly 12 is being mounted on the bag.

Figure 7:
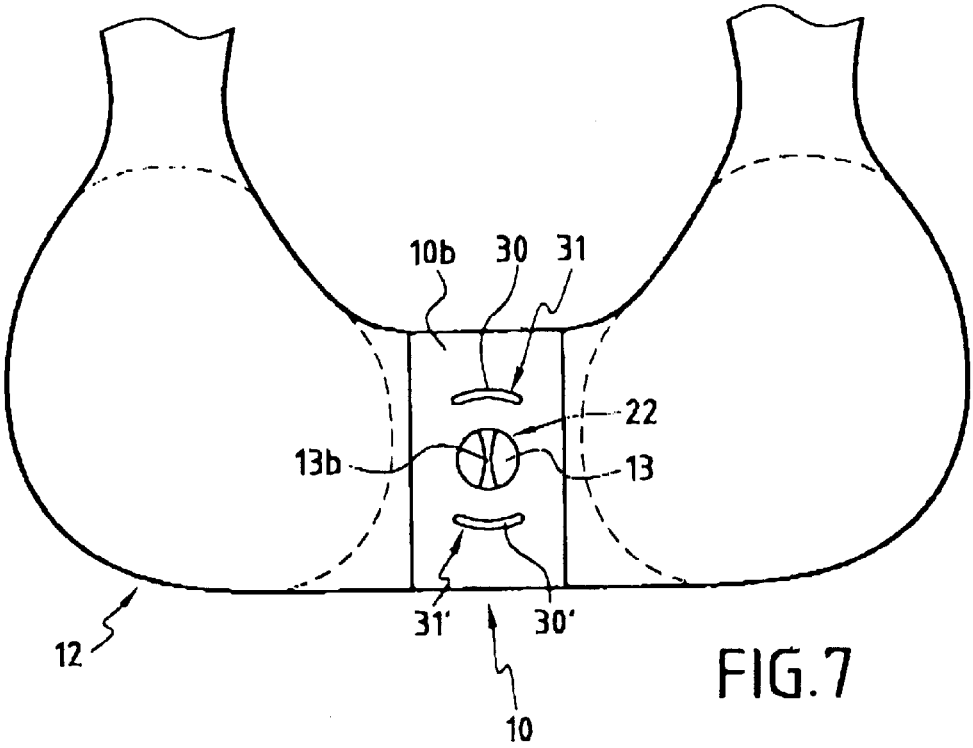
FIG. 7 is a front view of the back of a knapsack fitted with the strip of FIGS. 5 and 6, with the knob accessible.
Figure 5:
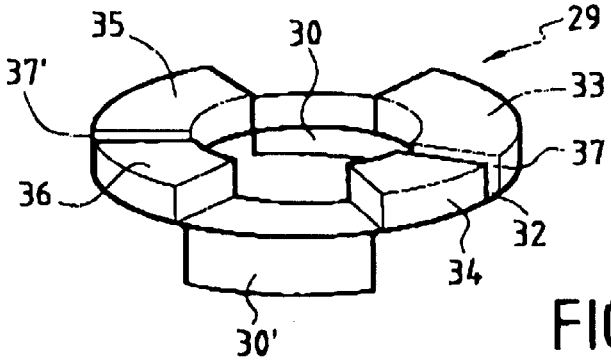
FIGS. 5 and 6 are respectively a perspective view and a front view of an annular elastomer strip.
Figure 6:
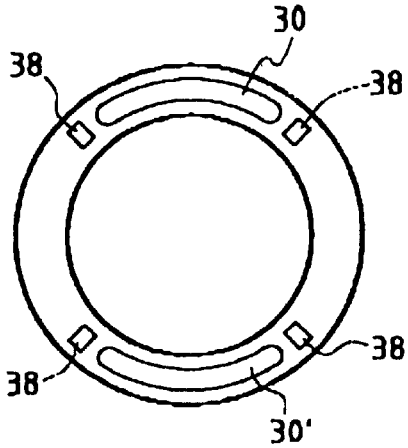

The elastomer strip 29 shown in FIGS. 5 to 7 differs from that shown in FIG. 3 in that it is annular in shape and in that it has two oblong identifying portions 30 and 30' that can be seen through two windows 31 and 31'. More precisely (FIG. 5), the elastomer strip 29 has a fully annular portion 32 of small thickness, and on either side and in elevation relative to said annular portion 32, it has:

- on the first face, two sets of active damping portions respectively referenced 33, 34 (on the right), and 35, 36 (on the left) that are separated by the grooves 37, 37'; and
- on the second face, two identifying portions 30, 30' disposed between the two active portions 33, 35 and 34, 36.

In FIG. 6, recesses 38 can be seen formed towards the ends of the active portions opposite from the grooves and opening out into the second face, which recesses serve to receive the anchor pads 17, 17'.

In addition to performing the identifying function through the windows 31 and 31', the identifying portions 30 and 30' which are engaged in two diametrically opposite portions formed in the male piece also serve to hold the elastomer strip 29 in position on said male piece.

Figure 4:
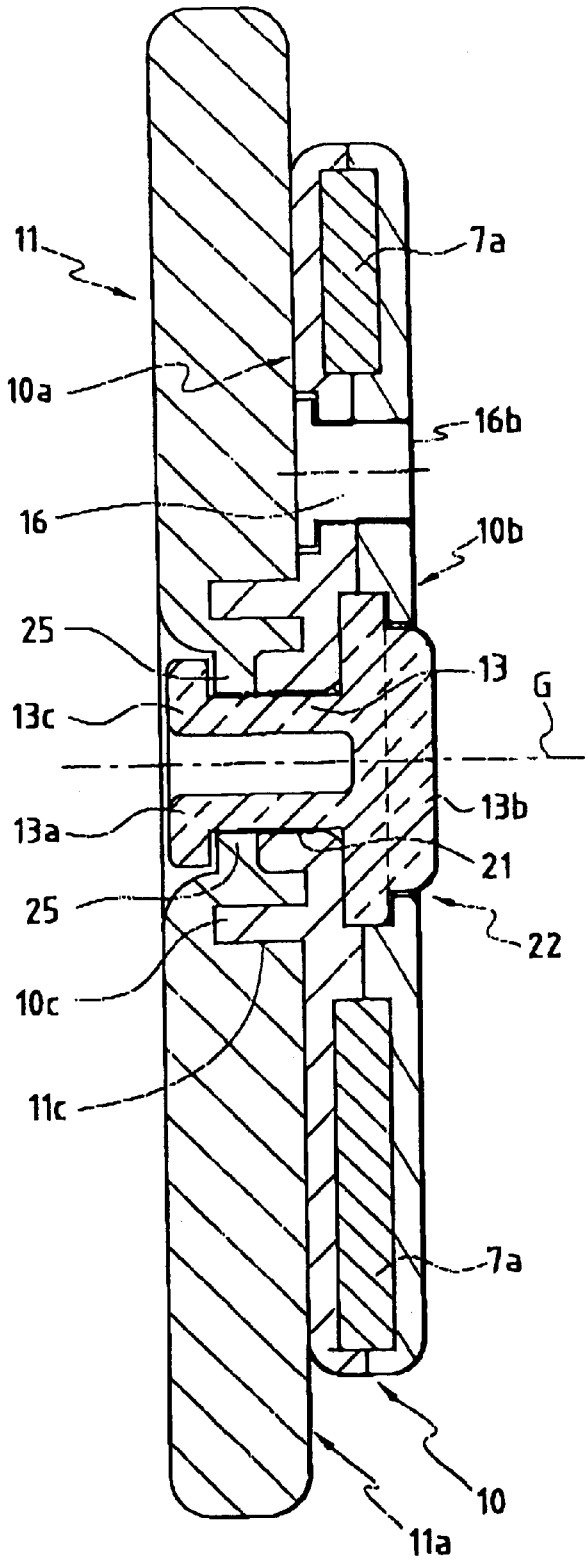
FIG. 4 is a longitudinal section on axis IV—IV of FIGS. 2 and 3 through the male and female pieces after they have been assembled together and before they have been locked together.

With reference to FIGS. 3 and 4, the fixing head 13 is mounted to be free to turn in a housing 21 formed in the male piece 10, said housing opening out both into the rear face 10*a* and into the front face 10*b* of the male piece 10. The projecting fastening portion 13*a* passes through the first opening, which portion is of T-shaped cross-section, while a handling tab 13*b* or knob passes through the second opening to allow the user to fasten the male and female pieces 10 and 11 together, i.e. to fasten the strap assembly 12 to the back 26 of the bag. The knob 13*b* is elongate in shape and it is turned through an angle of not more than 90° between two extreme positions: a first position (FIG. 7) corresponding to inserting the projecting portion 13*a* into the central recess 15; and a second position obtained by turning the knob through 90° which corresponds to the male and female pieces 10 and 11 being fastened together. This fastening is obtained by a set of two abutments formed in the housing 21.

Figure 9:
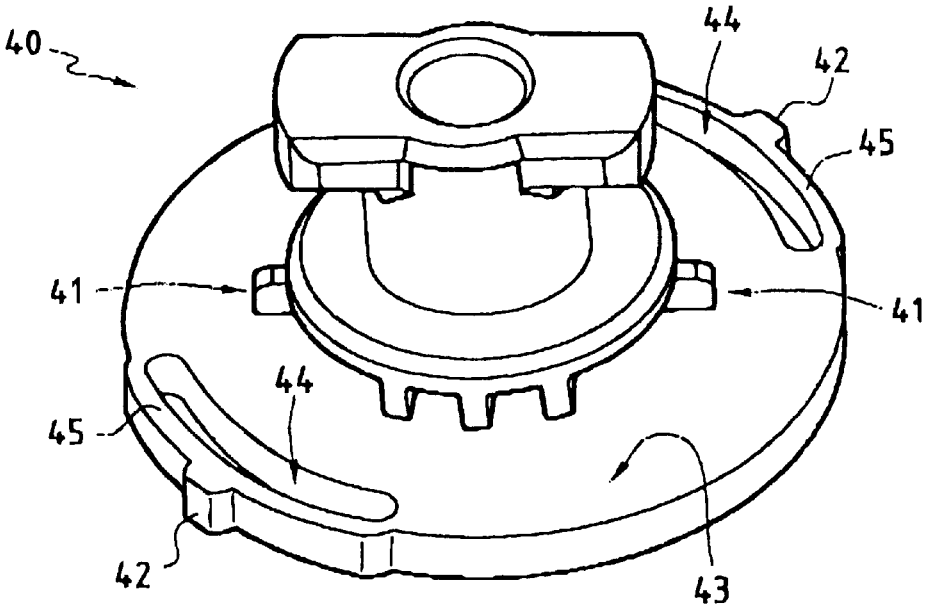
FIG. 9 is a perspective view of a fixing head.

In the example shown in FIG. 9, the fixing head 40 is fitted for each of the extreme positions with a respective abutment 41 and an audible positioning click 42. The two abutments 41 carried by the fixing head 40 co-operate with the set of two abutments formed in the housing 21. The click 42 is shaped on the periphery of the circular support 43 on which the knob is fixed (not visible in FIG. 9). Two semicircular slots 44 are provided on the periphery of the circular support 43 to define two arches 45. The two clicks 42 are constituted is by respective radially protecting portions of the two arches 45. The circular support 43 is mounted in a housing having two grooves provided therein that are suitable for receiving the two clicks 42. The shape of the housing in which the circular support 43 is placed is such that when the fixing head is turned from one extreme position to the other the click 42 is pushed back radially by the inside face of the housing with the arch bending towards the inside of the slot 44. Thus, to go from one extreme position to the other, the knob can be turned only by exerting enough force to bend the two arches 45 until the two arches relax as the two clicks penetrate into their respective housings thus generating a characteristic noise, thereby informing the user that the proper position has been reached.

The strap assembly 12 is put into position on the back 26 of the bag 14 by pressing the rear face 10*a* of the male piece 10 carried by the strap assembly 12 against the front face 11*a* of the female piece 11 carried on the back 26 of the bag, causing the T-shaped projecting portion 13*a* of the fixing head 13 to penetrate into the central recess 15 formed in the female piece 11 and then turning the knob 13*b* through 90°. Two locking lips 25 are provided on either side of the recess 15 and the two limbs 13*c* of the T-shaped projecting portion 13*a* are engaged behind them as the fixing head 13 is turned through 90° by means of the knob 13*b*.

In order to make it easier to center the male and female pieces 10 and 11 relative to each other, respective complementary projecting and setback circular portions are provided on the front faces 10*a* and 11*a* of said pieces 10 and 11, said circular portions being centered on the pivot axis G. In the example shown in FIG. 4, it is the male piece 10 which has the projecting portion 10*c* while the female piece 11 has the setback portion 11*c*.

The elastomer strip 16 can optionally be replaced if it becomes damaged or worn, and it is very easy to replace since all that is required is to engage it on the tabs 17, 17', said strip being prevented from moving laterally when inside its housing 18 (FIG. 3).

The elastomer strip 16 can be made of natural or synthetic rubber or indeed of a synthetic elastomer of one of the following types: polyisoprene; butadiene styrene copolymer; polybutadiene; ethylene and propylene copolymer; ethylene, propylene, and diene terpolymer; or indeed isoprene and isobutylene copolymer; without this list being limiting. In a particular embodiment, the elastomer used is styrene-ethylene-butadiene-sytrene (SEBS) as sold under the trademark SANTOPRENE, having a hardness of 60 on the Shore A scale.

In a particular embodiment, the distance between the groove 19 and the tabs 17 is about 15 mm for a strip having a width of about 10 mm and a thickness of about 10 mm in the active compression zones lying between the groove 19 and the tabs 17, 17'.

In the above-described embodiment, the female piece 11 is fixed by any conventional means to the back 26 of the bag 14. However, if the back 26 of the bag is itself made of a flexible textile material, a certain amount of deformation can also occur in the flexible material in the vicinity of the female piece 11 during angular pivoting of the strap assembly, which is why a second variant has been proposed in which the female piece 11 is integrated in the stiffening reinforcement of the knapsack, e.g. in the form of a long piece 28 extending vertically along the height of the knapsack and secured by any suitable means to the back thereof.

Figure 8:
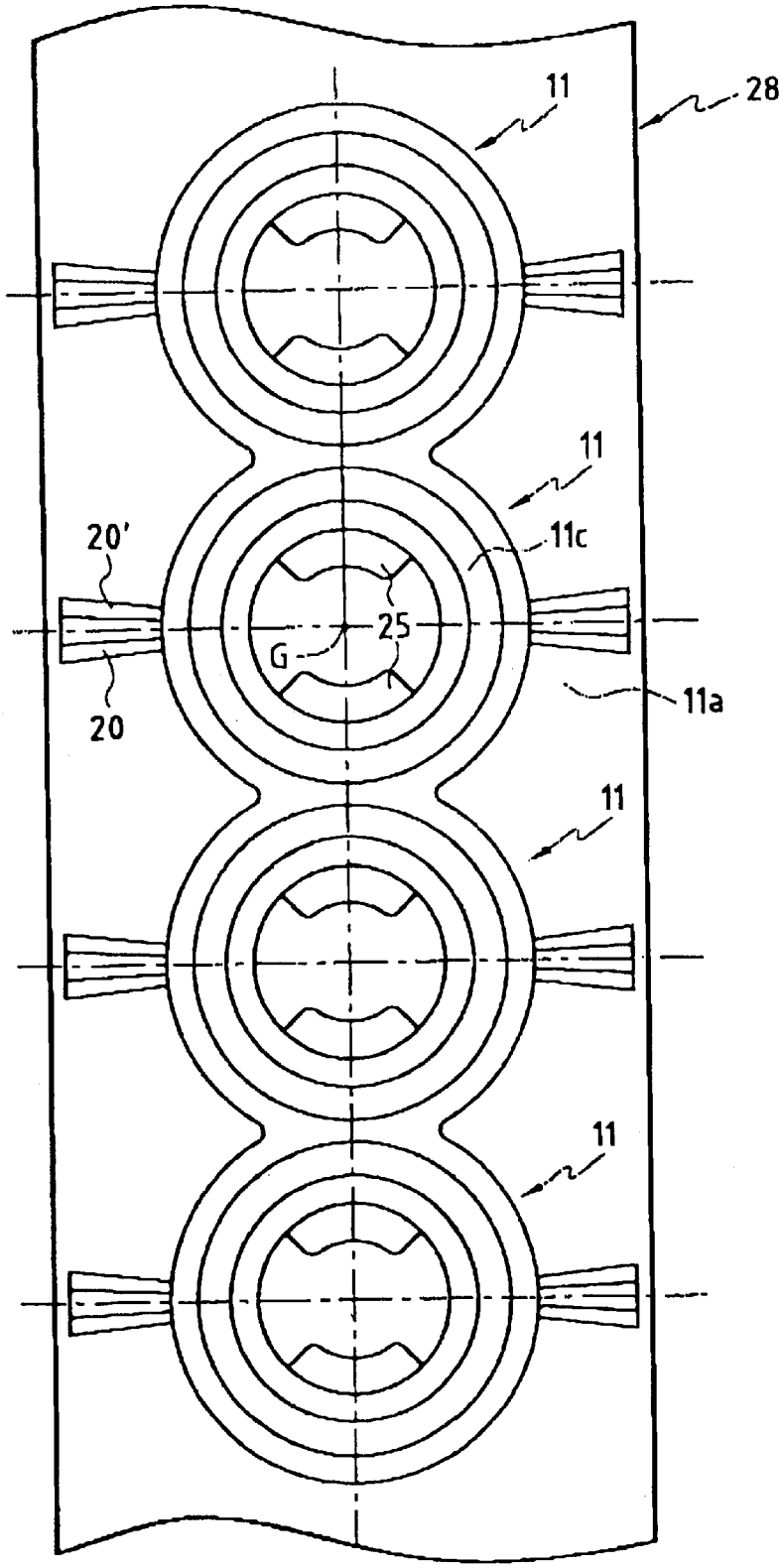
FIG. 8 is a fragmentary view showing a portion of reinforcement for stiffening a knapsack and provided with a plurality of female pieces.

In this second embodiment, the vertical piece 28 constituting the reinforcement preferably includes, at least towards the top thereof, a plurality of superposed elements acting as female pieces. In the example shown in FIG. 8, four such female pieces 11 are shown one above the other, each having exactly the same structure as that described above. The advantage of having such a plurality of female pieces is to enable the height of the strap assembly relative to the back of the bag to be adjusted, and more precisely to enable the spacing between the fastening of the belt assembly and the fastening of the strap assembly to be adjusted as a function of the size of the user.

The male portion 10 is fixed by any conventional means to the strap assembly. By way of example, it can be constituted by an assembly comprising a plurality of pieces suitable for clamping between them an appropriately-shaped portion 7*a* of the central zone 7 of said strap assembly.

The present invention is not limited to the embodiments described above as non-exhaustive examples. In particular, it should be observed that the fastening system of the invention can be applied not only to a strap assembly but also the belt assembly of a knapsack. When the knapsack is fitted with a strap assembly made up of a one-piece shoulder-blade pad element and two carrying shoulder straps as described in document WO 00/19863, then the male piece 10 (FIG. 3) can constitute all or part of the central zone 7 (FIG. 1) of the one-piece element 5 between the side zones which are generally higher than the central zone, being fitted with padding for bearing against the shoulders.

In addition, the first and second pieces are not necessarily a male piece with a fixing head and a female piece with a central recess as described above. The means used to provide co-operation between the two pieces so as to achieve fastening with pivoting can be different, providing they make it possible for the two pieces to pivot relative to each other about a pivot axis that is perpendicular to the back of the bag. The elastomer element is not necessarily annular in shape. For example, the first and second pieces can be bonded by adhesive to two opposite faces of a square plate of elastomer.

Figure 10:
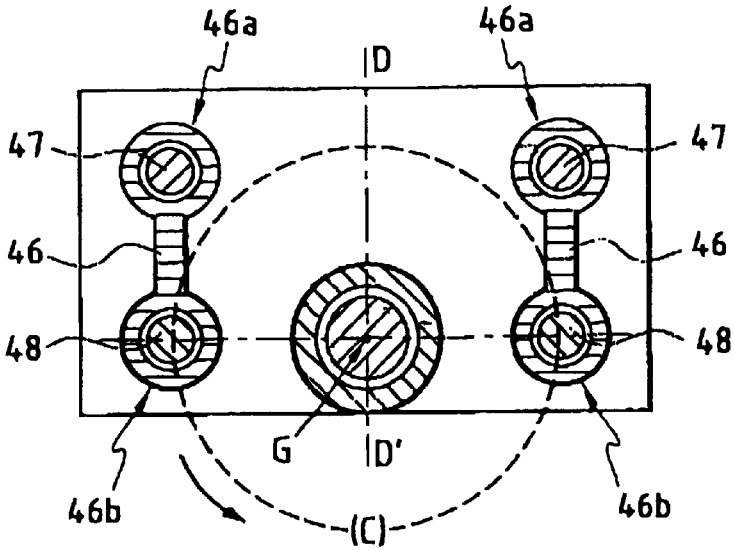
FIG. 10 is a front view of a fastening system having two tensioners.

In the above-described example, the deformation of the elastomer element during angular pivoting of the first piece relative to the second piece is obtained by pressure giving rise to progressive compression of the elastomer. The invention is not limited to that type of deformation. It is mentioned above that deformation in shear could be used when the first and second pieces are bonded to two faces of the elastomer element. The deformation of the elastomer element can also be in traction, in twisting, or in bending. For example, for deformation in traction, the elastomer element can be implemented in the form of two elongate tensioners 46 (FIG. 10) which are placed parallel to the mid-axis DD' of the knapsack at equal distances therefrom and which have their free ends 46*a* and 46*b* fixed respectively to the first piece which is secured to the strap assembly (and/or the belt assembly) for the first end 46*a*, and to the second piece which is secured to the back of the bag for the second end 46*b*. In the example shown in FIG. 10, the two tensioners 46 are terminated by annular ends engaged on studs 47 and 48 carried respectively by the first and second pieces. The studs 48 carried by the second piece are in alignment with the pivot axis G. Thus, the tensioners 46 extend generally substantially tangentially relative to a circle centered on the pivot axis G and passing through the two studs 48. Angular pivoting of the strap assembly relative to the back of the bag as caused by relative movements of the user's body thus causes the studs 48 to move around the circle C. This movement will cause one of the tensioners to be subjected to traction so that the deformation of the tensioner opposes the pivoting and provides the looked-for damping function. For the other tensioners the pivoting gives rise to deformation in bending which also opposes said angular pivoting, although doubtless to a lesser extent.

What is claimed is:

1. A knapsack comprising a bag, a strap assembly for securing the bag to the shoulders of a user, a belt assembly for securing the bag around the waist of the user, and a fastening system for fastening the strap assembly and/or the belt assembly to the back of the bag, said fastening system comprising a first piece secured to the strap assembly and/or the belt assembly and a second piece secured to the back of the bag, said pieces co-operating with each other to enable the first and second pieces to be fastened together and to pivot mutually about a pivot axis perpendicular to the back of the bag, wherein the fastening system comprises:

a) at least one elastomer element secured to one of the two pieces; and b) engagement means secured to the other piece and engaging the elastomer element at least during pivoting so that during pivoting the engagement means causes the elastomer element to be deformed, thereby opposing said pivoting.

2. A knapsack according to claim 1, wherein the elastomer is selected to ensure that the angular pivoting lies in the range −5° to +5° about a normal position.

3. A knapsack according to claim 2, wherein the elastomer element is made of vulcanized elastomer or of thermoplastic elastomer of determined hardness on the Shore A scale.

4. A knapsack according to claim 1, wherein the elastomer element is fixed via two anchor points to the rear face of the first piece and presents at least one hollow zone between the two anchor points, and wherein the front face of the second piece includes a projecting stud, said stud penetrating snugly into the hollow zone of the elastomer element when the two pieces are fastened together.

5. A knapsack according to claim 4, wherein the elastomer element has a transverse groove and the stud is in the form of an elongate shoulder, the groove and the shoulder extending radially relative to the pivot axis.

6. A knapsack according to claim 1, wherein the elastomer element is in the form of a partially or fully annular strip centered on the pivot axis, and wherein the fastening system has two diametrically opposite assemblies each constituted by at least one hollow zone, optionally together with a radial rib, and one stud per hollow zone, optionally together with an elongate shoulder.

7. A knapsack according to claim 6, wherein the two assemblies are disposed symmetrically about the vertical axis of the knapsack.

8. A knapsack according to claim 1, wherein the first piece has a window enabling a portion of the elastomer element to be seen from the front face of said first piece.

9. A knapsack according to claim 1, wherein the first and second pieces have respective circular portions both centered on the pivot axis, one of said portions being in relief and the other one of said portions being set back, said portions being suitable for being fitted one within the other.

10. A knapsack according to claim 1, wherein the elastomer element is constituted by two tensioners each having one end fixed to the first piece and an opposite end fixed to the second piece, said fixing constituting the engagement means engaged with the corresponding tensioner so that during pivoting one of the tensioners is deformed in traction and the other tensioner is deformed in bending.

11. A knapsack according to claim 1, wherein the second piece is integrated in a reinforcement for stiffening the knapsack.

12. A knapsack according to claim 11, wherein the stiffening reinforcement has a plurality of superposed elements each having the structure of a second piece, thereby enabling the height of the strap assembly and/or the belt assembly to be adjusted relative to the back of the bag.

13. A knapsack according to claim 1, wherein the first piece secured to the strap assembly and/or the belt assembly, is a male piece, having a fixing head projecting from the rear face of said piece, and the second piece secured to the back of the bag, is a female piece presenting a central recess opening out in its front face, said male and female pieces co-operating with each other to enable the male piece to be fastened to the female piece while being free to pivot about a pivot axis corresponding to the axis of the fixing head.

14. A knapsack according to claim 13, wherein the fixing head is mounted to turn freely in a housing that opens out into both faces of the male piece, wherein said head is terminated at one end by a handling tab accessible to the user via the opening leading to the housing, and is terminated at its other end by a T-shaped fastening portion, and wherein the central recess of the female piece has two locking lips at its margin for retaining the two limbs of the T-shape after the fastening portion of the fixing head has penetrated into the recess and the handling tab has been turned to a determined angle.

15. A knapsack according to claim 14, wherein the determined angle is preferably 90°.

16. A knapsack according to claim 14, wherein the fixing head and its housing include a system of abutments and positioning clicks serving firstly to limit turning of the handling tab as a function of the determined angle, and secondly to provide a certain amount of locking for the fixing head when it reaches the two positions separated by said angle, namely a first position in which the front portion of the fixing head is inserted into the recess, and a second position in which it is locked in position after being turned.

17. A knapsack according to claim 16, wherein the determined angle is preferably 90°.

* * * * *